US005388383A

United States Patent [19]

Covington

[11] Patent Number: 5,388,383

[45] Date of Patent: Feb. 14, 1995

[54] STRUCTURAL MEMBER JACKING DEVICE

[76] Inventor: Guy P. Covington, 768 Old Herald Harbor Rd., Crownsville, Md. 21032

[21] Appl. No.: 83,307

[22] Filed: Jun. 29, 1993

[51] Int. Cl.[6] ..... E04B 1/00

[52] U.S. Cl. ..... 52/741.1; 52/749

[58] Field of Search ..... 52/741.1, 126.5, 126.6, 52/125.1; 254/11.14, 133 R, 134

[56] References Cited

U.S. PATENT DOCUMENTS

| | | | |
|---|---|---|---|
| 2,305,906 | 12/1942 | Smith | 212/1 |
| 3,365,080 | 9/1965 | Crull | 214/1 |
| 3,438,514 | 5/1967 | Bose et al. | 214/1 |
| 4,027,802 | 6/1977 | Reynolds | 214/1 |
| 4,058,952 | 11/1977 | Donnelly | 52/125.1 X |
| 4,624,447 | 11/1986 | Richmeier | 254/93 H |
| 4,661,749 | 4/1987 | Finkbeiner | 318/41 |
| 4,715,760 | 12/1987 | Browning | 414/10 |
| 4,980,999 | 1/1991 | Terenzoni | 52/125.6 |

*Primary Examiner*—Carl D. Friedman
*Assistant Examiner*—Creighton Smith
*Attorney, Agent, or Firm*—Foley & Lardner

[57] ABSTRACT

A structural member jacking device and method for incrementally raising or lowering a structural member. A structural member jacking device includes a first vertical support column with a repositionable stop. A second vertical support column with a repositionable connector, positioned below a structural member, is movable relative to the first support column and connected thereto by the repositionable connector. An extender is mounted on the second support column and postionable on the stop. A structural member may be raised by positioning the stop below the extender, then extending the extender against the stop, whereby the second support column is raised. The repositionable connector removably pins the first and second columns, while the extender is retracted toward the second support column. Repeating these steps results in incrementally raising the structural member. Performing these steps in a reverse manner results in lowering the structural member. A plurality of structural member jacking devices may be synchronized.

12 Claims, 5 Drawing Sheets

STRUCTURAL MEMBER JACKING DEVICE

BACKGROUND OF THE INVENTION

1. Field of the Invention

The invention relates to a jacking device, and, more particularly, to a jacking device and method for use with a structural member of a building, which is useful for incrementally raising or lowering the structural member and/or members simultaneously.

One of the most serious problems that can face an owner of a structure is that the ceiling is too low or too high. This problem commonly occurs in commercial structures, such as warehouses. Once the structure has been built, it may be discovered, for example, that the ceiling is too low to permit storage of taller items. Thus, it may be necessary to raise or lower the ceiling.

This problem can also occur in structures with multiple stories. In these situations, the ceiling that needs to be raised may also be the roof, or the floor of another story.

The ability to increase the overall height of the structure may be limited by, for example. building codes when the structure is at or near a maximum height. In situations such as these, in order to increase the distance between the floor and the ceiling, the floor must be lowered.

Moreover, it may be desired to raise an entire side of a floor or ceiling, or, indeed, the entire floor or ceiling, in a coordinated manner.

There are also occasions during which it is desirable to either raise or lower other structural members. For example, a roof may be raised and positioned prior to being secured to a new building.

2. Description of the Related Art

It is known that a roof may be raised as an entire structure. Systems and devices for raising an entire roof structure are known, and are disclosed, for example, in U.S. Pat. No. 4,980,999, issued to Robert S. Terenzoni, and U.S. Pat. No. 2,305,906, issued to William Herbert Smith. These systems and devices, however, are unsuitable for the purpose of increasing or decreasing the distance between a roof or ceiling.

Hydraulic jacks associated with building structures are generally known. One such jack is shown in U.S. Pat. No. 4,715,760, issued to Ervin R. Browning. A pneumatic cylinder rests on a pin at a selected pair of holes so as to initially manually position the cylinder. The piston rod then is extended, and remains extended at a selected vertical position. Unfortunately, the Browning device is primarily useful for such relatively light building components such as cabinets and ceiling frames, and could benefit from improved safety. Moreover, the degree of extension is determined by the length of the piston.

A jack using a pin and hole height adjustment feature is also known, as shown in U.S. Pat. No. 4,624,447, issued to Thomas L. Richmeier. As in the Browning patent, the piston rod is extended until the selected position is reached. Although the Richmeier device is versatile, it has some of the disadvantages discussed above, and further has the disadvantage of having many parts.

Other conventional jacking devices for raising individual components of a building are known. For example, U.S. Pat. No. 4,027,802, issued to Francis Reynolds, discloses a positioner for use with building panels to be positioned adjacent to a ceiling or wall framework. U.S. Pat. No. 3,438,514, issued to Gordon D. Bose, discloses a powered lift for elevating sheetrock to a horizontal position adjacent to a ceiling. U.S. Pat. No. 3,365,080, issued to William F. Crull, discloses another apparatus for lifting and supporting panels in a horizontal position, such as ceiling boards held in place while being secured to a ceiling structure. These jacking devices have limitations and disadvantages similar to those already discussed.

A variety of apparatuses for inducing synchronization in jacking devices are known, disclosed in U.S. Pat. No. 4,661,749, issued to Walter Finkbeiner. Even when used with conventional jacking devices, the usual limitations and disadvantages of the conventional jacking devices are not overcome.

Thus, there is a need for a structural member jacking device with improved safety and ease of use, while at the same time providing a large range of extensibility and capable of being incrementally raised or lowered. There is also a need for a structural member jacking device which can be left in place for an extended period of time, once the desired positioning is achieved. There is a further need for a structural member jacking device with which a plurality of the structural member jacking devices may be raised or lowered at more than one point in a synchronized manner.

SUMMARY OF THE INVENTION

It is therefore one object of the invention to provide a structural member jacking device with improved safety, and improved ease of use.

It is another object of the invention to provide a structural member jacking device with a large range of extensibility.

It is yet another object of the invention to provide a structural member jacking device which is capable of incrementally raising or lowering a structural member.

It is an additional object of the invention to provide a structural member jacking device with which a plurality of structural members may be used to manipulate the structural member, that is, to raise or lower the structural member, at more than one point, in a synchronized manner.

It is yet another object of the invention to provide a structural member jacking device which can be left in place for an extended period of time.

It is one feature of the invention that a structural member jacking device is provided with a variably positionable hydraulic cylinder.

It is another feature of the invention that a structural member jacking device utilizes safety pins which are inserted as the structural member is incrementally raised.

It is an advantage of the invention that a plurality of structural member jacking devices may be controlled so that a structural member may be raised or lowered equally at more than one point.

The structural member jacking device of the invention includes a first vertical support column with a repositionable stop. A second vertical support column with a repositionable connector is movable relative to the first support column and repositionably connected thereto by the repositionable connector. An extender, mounted on one of the support columns, is postionable on the stop.

In accordance with a further aspect of the invention, there is provided a common power source. A plurality of structural member jacking devices are synchronizingly connected by a plurality of power lines to the common power source. According to one preferred aspect of the invention, a synchronizing connector connects the power lines to the common power source.

The method of incrementally raising a structural member of the invention includes inserting a plurality of extendible-retractable columns between a floor and a ceiling. At least some of the extensible-retractable columns are actuated in a same direction to manipulate the ceiling.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

An exemplary embodiment of the invention is illustrated in the drawings and described in detail below with reference to the accompanying drawings, wherein.

DETAILED DESCRIPTION OF THE PREFERRED EMBODIMENTS

Figure 1:
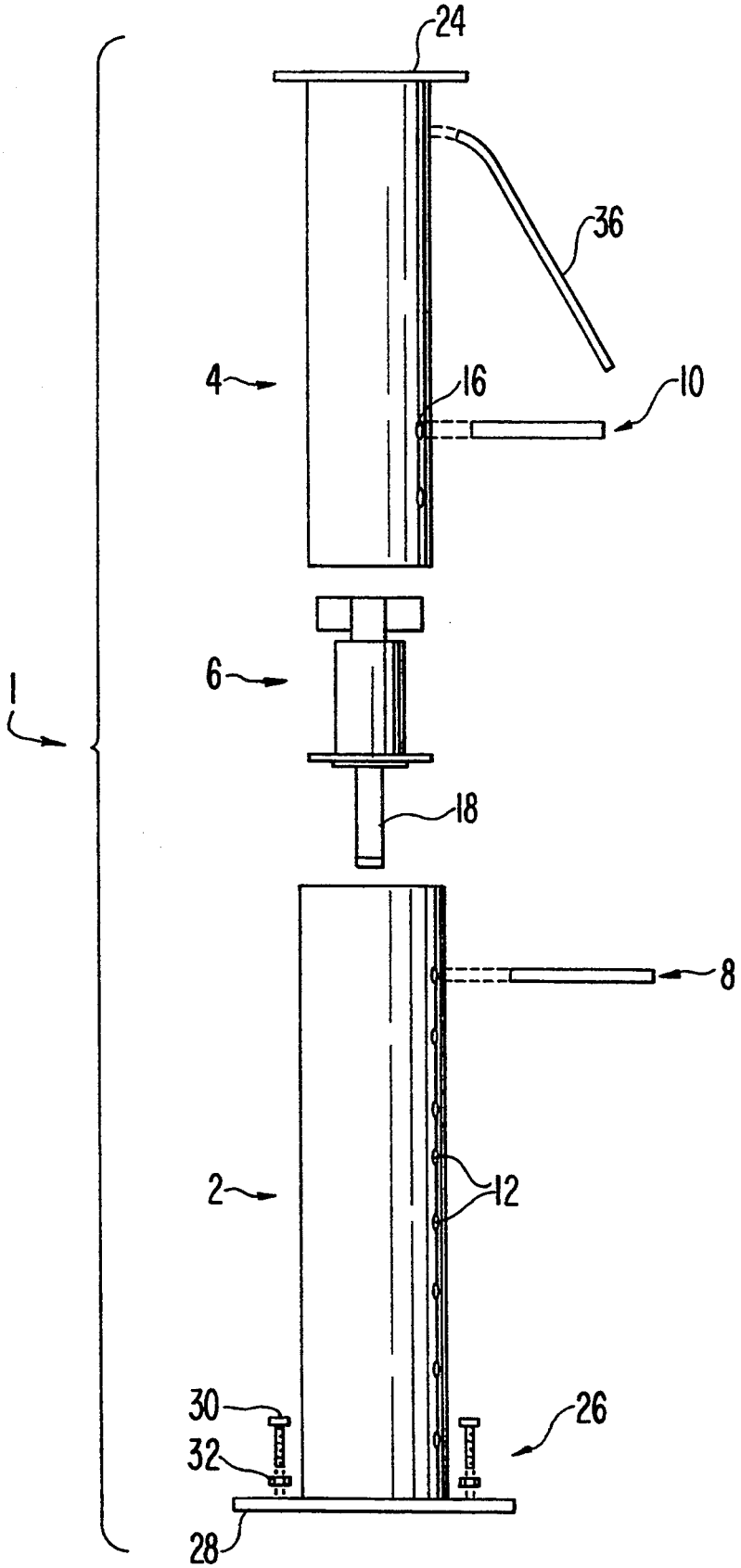
FIG. 1 is an exploded view of one embodiment of a structural member jacking device.
Figure 2:
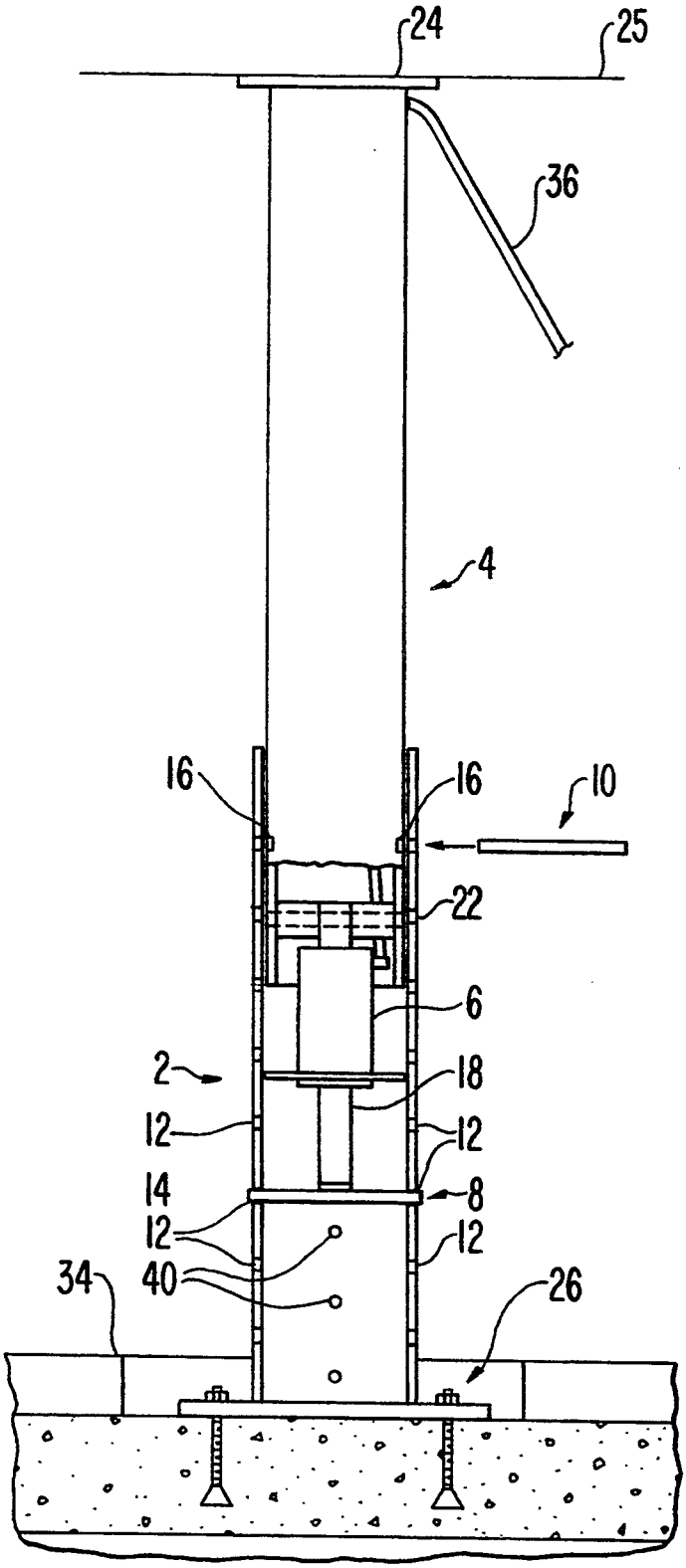
FIG. 2 is a sectional view of the structural member jacking device of FIG. 1 in a first position, shown used with a structure.

FIG. 1 illustrates the general structure of one embodiment of a structural member jacking device 1. The structural member jacking device 1 includes a first vertical support column 2, a second vertical support column 4, and an extender 6. As illustrated in FIG. 2, the second support column 4 is telescopically positioned adjacent to the first support column 2.

The first vertical support column 2 includes a repositionable stop 8. The second vertical support column includes a repositionable connector 10. The first support column 2 is repositionably connected to the second support column 4 by the repositionable connector 10. In order to be telescopic with respect to each other, the first support column 2 is preferably a hollow column, with the second support column 4 being a hollow column, which is then positioned internally with respect to the first support column 2.

FIG. 2 illustrates the structural member jacking device in a first position. The extender 6 is mounted on the second support column 4, preferably on a bottom portion thereof. The second column 4 is in a higher position than the first column 2, and the extender 6 is positioned so as to rest on the stop 8.

The repositionable stop 8 preferably includes a plurality of vertically separated pairs of first opposing apertures 12 in the first support column 2, and a jack pin 14 adapted to be removably inserted through one of the pairs of first apertures 12.

The repositionable connector 10 preferably includes at least one pair of second opposing apertures 16 in the second support column 4; and a safety pin 10 adapted to be removably inserted through one of the pairs of first apertures 12, and the pair of second apertures 16.

The first and second opposing apertures 12, 16 are preferably shaped so that the jack pin 14 and safety pin 10, respectively, can be removably inserted therethrough. As illustrated, the safety pin 10 is advantageously a cylindrical member, and the second opposing apertures 16 advantageously have a circular shape. The jack pin 14 is similarly advantageously a cylindrical member, and the first opposing apertures 12 advantageously have a circular shape.

The second opposing apertures 16 are preferably disposed on the second column 4 so as to be incrementally positionable adjacent to each pair of the first opposing apertures 12, as the second column 4 is moved upwards or downwards. Moreover, the pairs of first opposing apertures 12 are preferably vertically disposed on the first column 2 at a distance of approximately six inches. It will be appreciated that the distance may vary, depending on the type of structural member with which the jack is to be operated, and the desired increment. Alternate apertures 40 for use at other times may be disposed on one or both of the first and second support columns 2, 4.

The extender 6 should be able to be extended vertically. Additionally, the extender 6 is preferably able to retract vertically. To enable the extender 6 and thus the second column 4 to be raised relative to the first column 2, the extender 6 preferably extends a distance at least as long as the distance between the first pairs of opposing apertures 12.

Preferably, the extender 6 is an extendable ram. Nevertheless, since a purpose of the extender 6 is to provide both an extension and a retraction, other types of extenders are possible. Power may be provided for the extender 6 in a variety of manners. Preferably, when the extender 6 is an extendable ram, the extendable ram is hydraulically powered.

Figure 3:
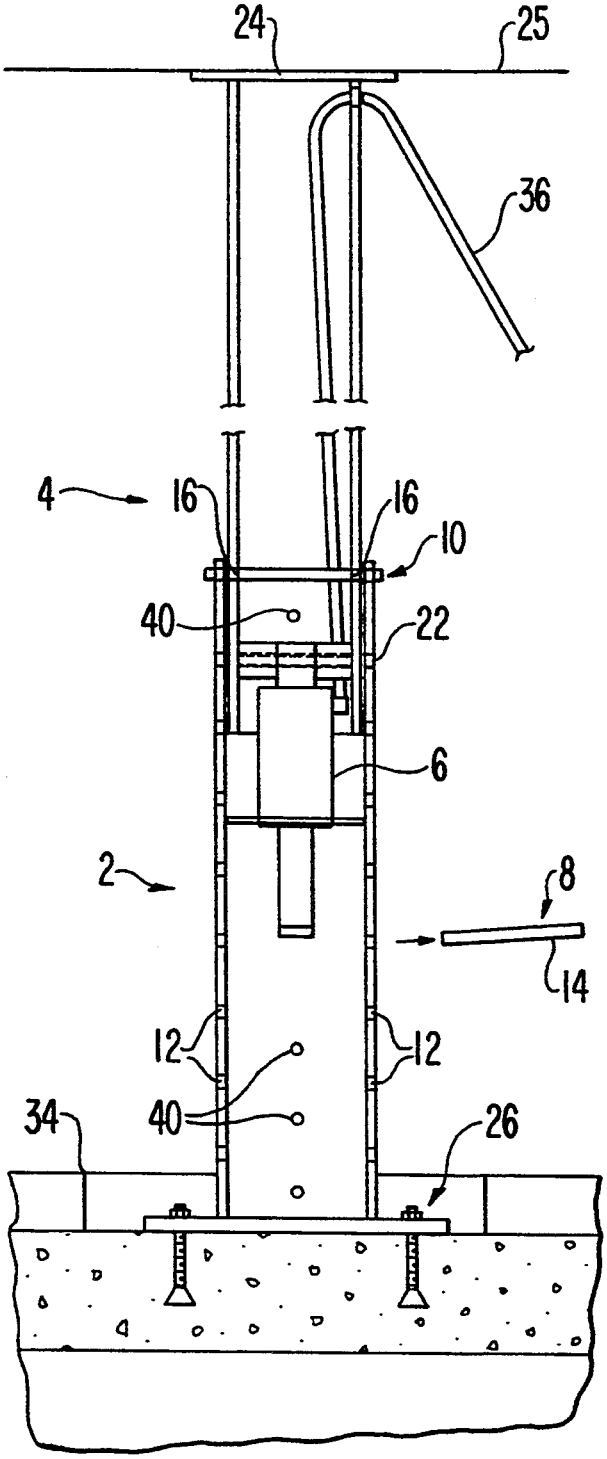
FIG. 3 is a sectional view of the structural member jacking device of FIG. 1 in a second position, shown used with a structure.

FIG. 3 illustrates the structural member jacking device in a second position. The second column 4 is in a higher position relative to the first column 2, than the position illustrated in FIG. 2. This figure also illustrates the jack pin 14 removed from the first column 2, while the safety pin 16 is inserted through the first and second columns 2, 4.

Figure 4:
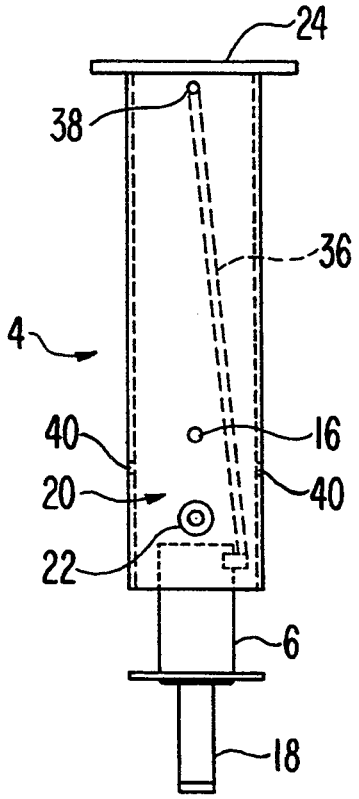
FIG. 4 is a side view of the second vertical support column of the structural member jacking device of FIG. 1.

Reference is now made to FIG. 4. In the embodiment, which is illustrated from a side view, the extender 6 includes an extensible member 18. The extensible member 18 provides the ability for the extender 6 to both extend and retract. Support columns including an extender with an extensible member are hereinafter referred to as extensible-retractable columns. Extensible-retractable columns may be actuated to either extend or retract vertically, or both.

The extender 6 is mounted by a mount 20 on the second support column 4, and is preferably permanently fixed in relation thereto. The mount 20 could include, for example, a rod 22 positioned through an upper portion of the extender 6 and through a lower portion of the second support column 4.

In order to provide for the secure positioning of the second column 4 below a structural member, a contact member 24 may be mounted on top of the second column 4. The contact member 24 may be adapted to the shape of the structural member with which it will be used. In the illustrated embodiment, the contact member 24 has a flat horizontal shape, which is suitable for use below floors. FIGS. 2 and 3 illustrate one embodiment of the contact member 24 used below a structural member 25.

Reference is made back to FIG. 1. In a similar manner, it is desirable to provide for a stabilizer 26 between the first support column 2 and a surface on which the jacking device will be used. In the illustrated embodiment, the stabilizer 26 includes a base plate 28, mounted on the first column 2, which may be connected to the surface. A connection may advantageously be provided by connecting the base plate 28 to the surface with a bolt 30 and nut 32. FIGS. 2 and 3 illustrate one embodiment of the stabilizer 26 connected to the surface 34.

It is normally desirable to externally provide power to the extender 6. In that situation, a power line 36 from the extender 6 may be run to a power source, whereby the extender 6 is powered. As illustrated in FIG. 4, the power line 36 is advantageously threaded through a power line aperture 38 in the second column 4 adjacent to an upper portion of the second column 4, and then connected to the extender 6.

Figure 5:
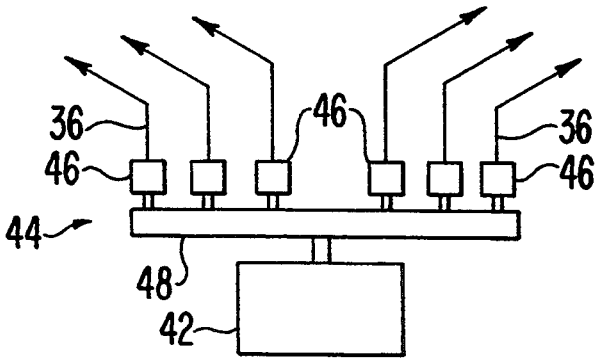
FIG. 5 is a plan view of a power source for synchronizingly connecting a plurality of structural member jacking devices.
Figure 6:
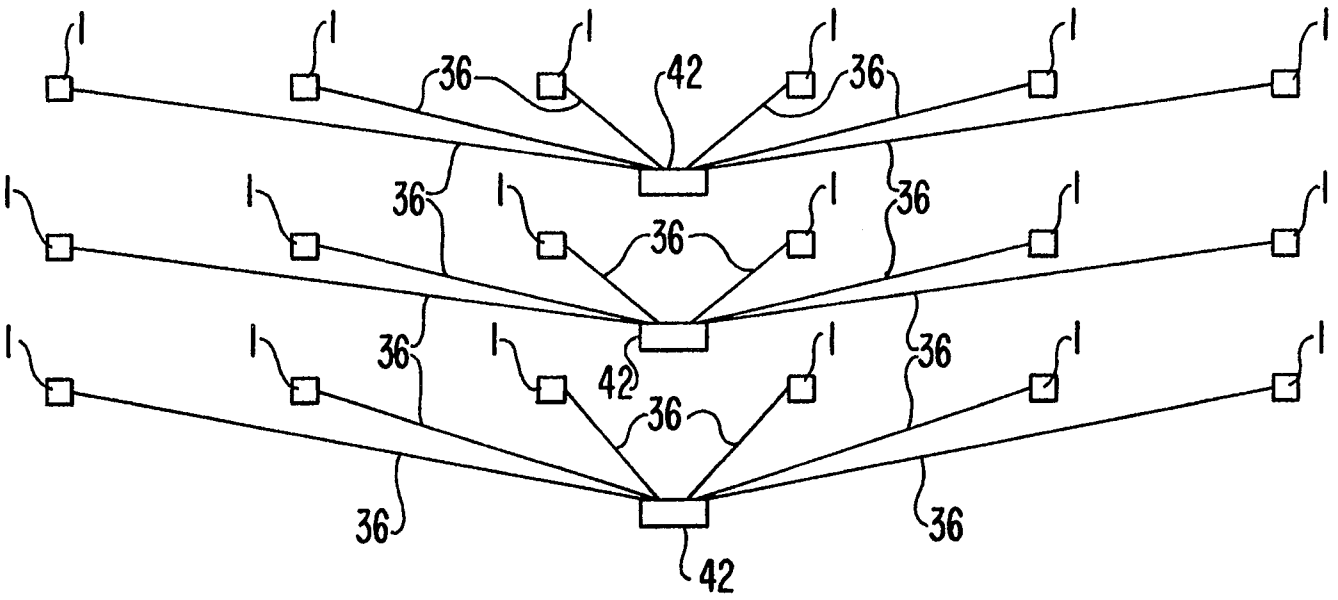
FIG. 6 is a plan view of a plurality of structural member jacking devices synchronizingly connected to a plurality of power sources.

A power source 42, of which one embodiment is illustrated in FIGS. 5 and 6, is preferably connected to the power line 36. It has been found that a 10K unit hydraulic pump is adequate to provide power to the extender 6. If the power source 42 is hydraulic, the power line 36 is preferably a hydraulic hose.

In some situations, it may be desirable to use and synchronize a plurality of structural member jacking devices. One such situation is when it is desired to raise a side of a floor. To provide synchronization, a power source 42 common to a plurality of the jacking devices 1 may be used, as illustrated in FIG. 5. The plurality of structural member jacking devices 1 are synchronizingly connected by a plurality of power lines 36 to the common power source 42. To synchronize the extenders 6 among the plurality of jacking devices 1, each power line 36 is connected via a synchronizing connector 44 to the common power source.

In the embodiment illustrated in FIG. 5, the synchronizing connector includes a plurality of metering valves 46, one on each hydraulic hose 36. A manifold 48 is connected between all of the metering valves 46 and to the common power source 42.

FIG. 6 illustrates several pluralities of synchronized jacking devices 1. In some situations, it may be desirable to use groups of synchronized jacking devices 1. An example of this situation is when an entire floor is to be raised. Several pluralities of jacking devices 1, where each plurality is connected to a separate power source 42, may be provided. Each plurality may be separately synchronized, or may be synchronized in coordination, manually or by computer as the situation requires.

The illustrated jacking device may be used as in the following example. The first vertical support column 2 is provided, and the second vertical support column 4 is telescopically positioned adjacent to the first support column 4 and under the structural member 24. The jacking pin 14 is inserted into the first support column 2 through a pair of the first opposing apertures 12, at a location below the extender 6.

Next, the extender 6 is extended against the jacking pin 14, whereby the second support column 4 is raised. The upper portion of the first support column 2 above the jacking pin 14 is then pinned to the second support column 4 by a safety pin 10. Then, the extender 6 is retracted upward, toward the second support column 4. As a result, the second column 4 has been pushed upward by a fixed increment. The structural member below which the jacking device 1 is positioned is accordingly pushed upward by the fixed increment.

Ordinarily, more than one iteration of the process may be necessary to achieve the desired degree of lift of the structural member. Thus, while the safety pin 10 is inserted, and after the extender 6 has been retracted, the jack pin 14 is removed. The jack pin 14 is then inserted through a next pair of first opposing apertures, below the extender 6 which is now higher relative to its original position. The safety pin 10 is then removed, the extender 6 is extended, and the steps may be reiterated until the desired degree of lift is achieved.

If a plurality of jacking devices 1 are to be used, as in one of the above examples, the extending of the extender 6 is preferably performed substantially synchronously. However, each of the other steps may be performed independently.

It is possible to use the jacking device 1 to lower a structural member. In this case, the steps would be reiterated in a reverse manner, until the structural member is lowered to the desired position.

While specific embodiments of the invention have been described and illustrated, it will be clear that variations in the details of the embodiments specifically illustrated and described may be made without departing from the true spirit and scope of the invention as defined in the appended claims.

What is claimed is:

1. A method of raising or lowering a structural member, comprising the steps of:

(a) inserting a plurality of extensible-retractable columns between a floor and a ceiling;

(b) simultaneously actuating at least some of the extensible-retractable columns in a same direction to manipulate the ceiling; and (c) wherein the extensible-retractable column includes a first vertical support column movable relative to a second Vertical support column with an extender therebetween, and the actuating step includes moving the columns relative to each other by extending the extender.

2. The method of claim 1, including removing original columns initially supporting the structural member, after the plurality of extensible-retractable columns are inserted.

3. The method of claim 2, wherein the original columns initially supporting the structural member are removed after the plurality of extensible-retractable columns are actuated.

4. The method of claim 1, including removably inserting a stop into one of the support columns below the extender, and extending the extender against the stop, whereby the other support column is vertically moved.

5. The method of claim 4, further comprising removably pinning the support columns together.

6. The method of claim 5, wherein the stop includes a plurality of vertically separated pairs of first opposing apertures in one of the support columns, and a jack pin adapted to be removably inserted therethrough.

7. The method of claim 6, wherein one of the support columns includes at least one pair of second opposing apertures, and the pinning step includes inserting a safety pin through one of the pairs of first apertures and the pair of second apertures.

8. The method of claim 1, wherein the direction is vertically upward.

9. The method of claim 1, wherein the direction is vertically downward.

10. The method of claim 7, wherein the actuating is hydraulically powered.

11. The method of claim 10, wherein each extensible/retractable column is hydraulically powered from a common power source.

12. A method of raising or lowering a structural member, comprising the steps of:

(a) inserting a plurality of extensible-retractable columns between a floor and a ceiling, the extensible-retractable column including a first vertical support column movable relative to a second vertical support column with an extender therebetween;

(b) removably inserting a stop into one of the support columns below the extender;

(c) simultaneously actuating at least some of the extensible-retractable columns by hydraulic power in a same direction to manipulate the ceiling, by moving the columns relative to each other by extending the extender against the stop, whereby the other support column is vertically moved; and (d) removably pinning the support columns together.

* * * * *